United States Patent [19]

Rainey

[11] Patent Number: 4,809,878

[45] Date of Patent: Mar. 7, 1989

[54] PUMP DISPENSER FOR VISCOUS FLUIDS

[75] Inventor: Dean R. Rainey, Clinton, Conn.

[73] Assignee: Chesebrough-Pond's Inc., Greenwich, Conn.

[21] Appl. No.: 212,129

[22] Filed: Jun. 24, 1988

Related U.S. Application Data

[63] Continuation of Ser. No. 8,024, Jan. 28, 1987, abandoned.

[51] Int. Cl.[4] ..... B65D 88/54

[52] U.S. Cl. ..... 222/321; 222/385; 222/257

[58] Field of Search ..... 222/107, 206, 209, 256, 222/257, 260, 320–321, 383, 385, 387, 391, 336, 340

[56] References Cited

U.S. PATENT DOCUMENTS

| | | | |
|---|---|---|---|
| 3,288,334 | 11/1966 | Corsette | 222/107 |
| 3,420,413 | 1/1969 | Corsette | 222/107 |
| 4,134,523 | 1/1979 | Hansen et al. | 222/389 |
| 4,402,431 | 9/1983 | Wiegner et al. | 222/327 X |
| 4,434,916 | 3/1984 | Ruscitti et al. | 222/321 |
| 4,485,943 | 12/1984 | Czech | 222/256 |
| 4,657,161 | 4/1987 | Endo et al. | 222/256 |
| 4,694,977 | 9/1987 | Graf et al. | 222/259 |

*Primary Examiner*—Michael S. Huppert
*Attorney, Agent, or Firm*—Melvin H. Kurtz

[57] ABSTRACT

A viscous product dispenser is described which comprises a tubular container body adapted to hold product, a take-up piston at the lower end of the body which decreases the internal volume of the container as product is dispensed from the container, and a bulk liquid pump dispenser at the upper portion of the container body having a dip tube extending into the container body and a finger depressible, spring-biased piston/cylinder pumping mechanism. The pumping mechanism of the bulk liquid pump dispenser has a product outlet conduit which is parallel and coaxial to the outlet axis of the dip tube and the center of the piston. The piston/-cylinder pumping mechanism is of substantially less cross-sectional area than the internal diameter of the container body.

6 Claims, 2 Drawing Sheets

PUMP DISPENSER FOR VISCOUS FLUIDS

This application is a continuation of application Ser. No. 008,024, filed Jan. 28, 1987, now abandoned.

BACKGROUND OF THE PRESENT INVENTION

1. Field of the Present Invention

The present invention is a pump dispenser for viscous fluids, namely creams, lotions, and the like.

2. Description of the Prior Art

The prior art shows a variety of dispensers for fluid masses which comprise a generally tubular container with a pumping mechanism at one end and a take-up piston at the other. In such dispensers, the pumping mechanism is adapted to dispense the product from the container. As product is removed from the container which holds it, the take-up piston is moved by atmospheric pressure towards the pumping mechanism to insure that the fluid product and any associated reservoir in the pumping mechanism do not develop unwanted voids or open spaces which would interfere with the desired dispensing action on subsequent uses of the dispenser. One approach to the design of an appropriate pumping mechanism for one end of such containers is to provide a container body part which is resiliently compressible to effect a decrease in volume of a pumping chamber so as to cause the dispensing of product from the container. Examples of devices which use such an approach are U.S. Pat. Nos. 3,088,636; 3,361,305; 3,768,705; 4,154,371; 4,402,431; 4,413,759; 4,442,958; 4,474,313; and 4,533,069.

An alternative approach to the design of an appropriate pumping mechanism for tubular containers having a take-up piston at its opposite end is to provide a pumping dispenser having movable, rigid members which effect an appropriate volume reduction in a reservoir to dispense product therefrom. The following patents have been noted as following this approach:

U.S. Pat. No. 4,301,948 to J. Czech illustrates a pumping mechanism which comprises a head member in the form of a substantially cylindrical cap which is slidely supported on an outer side wall surface of the container. Movement of the head member towards the tubular container effects a reduction in a pump chamber containing the product to effect dispensing of the product through a suitable outlet in the head member.

U.S. Pat. No. 4,323,175 to J. Eckert illustrates a dispenser having a delivery device on the upper side of a supply container, transverse to the main direction in which the supply container extends. This delivery device has a cylinder space in which is arranged a displacement piston which is adapted to be displaced axially.

U.S. Pat. No. 4,485,943 to J. Czech shows a dispenser which utilizes a spring-biased piston to effect an appropriate reduction in the volume of a pump chamber. The path of egress of the material from the pump chamber to the outlet first lies in a direction lateral to the path of travel of the piston and thence parallel to the path of travel of the piston but laterally displaced therefrom.

U.S. Pat. Nos. 4,511,068 to J. Bossina and 4,598,843 to D. D. Foster et al. both show the use of spring-mounted pistons to effect removal of viscous product from the type of tubular container described before. In both cases the product is dispensed through outlet means in the piston structure initially in the direction that is parallel, and coaxial, with the path of travel of the piston, and the lateral dimensions of the piston are substantially the same as the inner diameter of the tubular container. In other words, the lower surface of the delivery piston at its circumferential portions makes sealing contact with the inner walls of the tubular container.

SUMMARY OF THE PRESENT INVENTION

The present invention is a viscous product dispenser which comprises: a generally tubular container body to hold the product; a take-up piston at the lower end of the body which responds to discharging of product from the container body by shifting its position towards the upper end of the body so as to decrease the internal volume of the container body holding the product by an amount corresponding to the volume of product discharged; and a bulk liquid pump dispenser at the upper portion of the container body which comprises an inlet for product extending into the container body portion intended to hold the product and a finger-depressible, spring-biased piston/cylinder pumping mechanism located within. The liquid pump dispenser has a product outlet conduit which is parallel to the axis defining the inlet for product from the container into the pump dispenser. The product outlet conduit within the pump dispenser is substantially coaxial with the center of the piston in the pumping mechanism. The piston in the pumping mechanism, which is movable towards and away from a reservoir within the cylinder encasing it, is substantially smaller in width than the internal width of the tubular container.

DESCRIPTION OF THE DRAWINGS

The present invention is further understood by reference to the Drawings which illustrate the present invention wherein.

DETAILED DESCRIPTION OF THE PRESENT INVENTION

Figure 1:
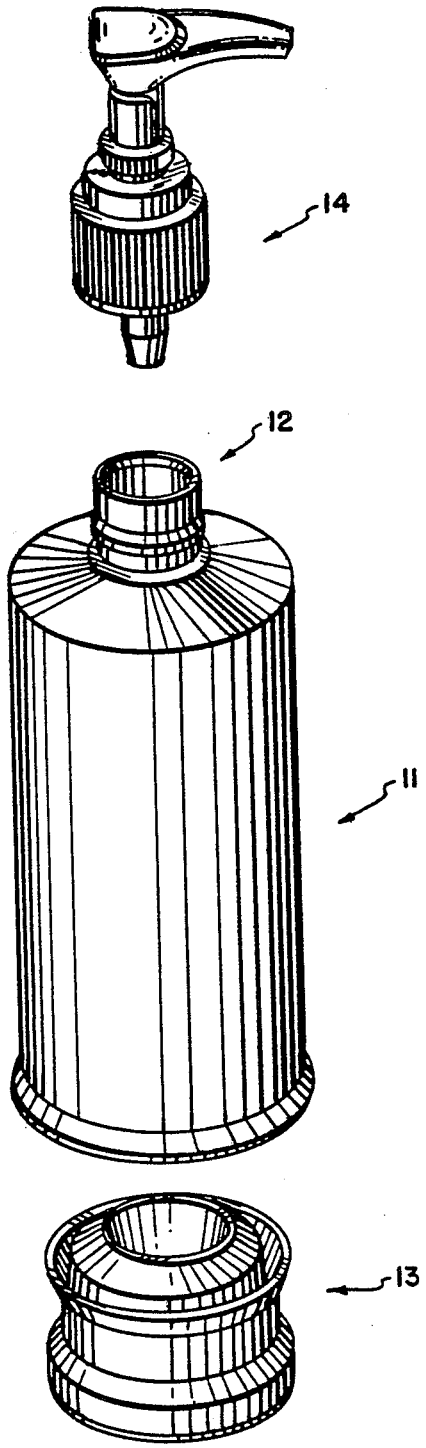
FIG. 1 is an exploded view, in perspective, showing the three major elements of the pumping mechanism.
Figure 2:
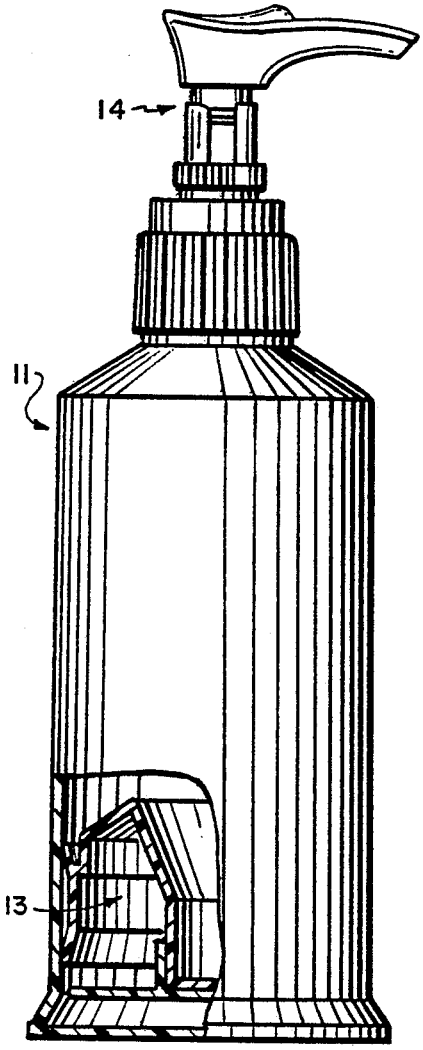
FIG. 2 is a view in partial cross-section showing the assembled container.

FIG. 1 illustrates, in perspective, the three major elements of the container of the present invention. These elements are novel, in combination, although the individual elements themselves are conventional. The first element is a tubular container 11 having a suitable outlet opening 12 at its upper end. This tubular container, at its opposed open end, is adapted to receive a take-up piston 13 which, under the influence of atmospheric pressure, is urged in an upward direction towards the outlet as product is pumped from the inside of the container 11. The combination of tubular container 11 and take-up piston 13 is broadly known as indicated by the Various U.S. patents referenced hereinbefore. Further details regarding this combination can be found therein.

The point of novelty for the present container relates to the use of a bulk liquid pump dispenser 14 rather than the various types of pumping mechanisms illustrated in the aforementioned U.S. patents. This bulk liquid pump dispenser is also a conventional item but has not been used in connection with the combination of a tubular container 11 and a take-up piston 13 as described and claimed herein. Commonly, the bulk liquid pump dispenser 14 used in connection with the present invention is utilized with containers that have a fixed bottom. Suitable liquid pump dispensers of this type are readily available from a number of commercial sources including Calmar Inc. of Watchung, N.J.

Figure 3:
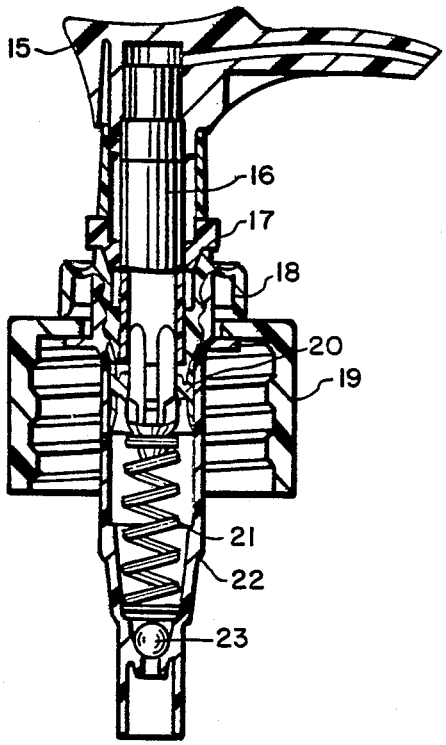
FIG. 3 is a cross-sectional view in greater detail of the bulk liquid pump dispenser.

FIG. 3 illustrates this type of pump dispenser 14 in cross-section in more detail. The pump comprises an eductor head 15, a dispenser piston 16, an optional locking ring 17, a caplet 18 and container cap 19, a piston seal 20, a responsor spring 21 and accumulator cylinder 22, and a spherical valve 23. The manner in which the pump dispenser shown in FIG. 3 is used is well known. Briefly stated, when a finger is used to depress eductor head 15, the dispenser piston 16 moves downwardly also moving piston seal 20 downwardly to wipe the interior surfaces of accumulator cylinder 22. This forces product up through an internal bore (not shown) within dispenser piston 16 and out through the communicating outlet bore in the head 15. Check ball valve 28 seals the inlet leading to the container as this occurs preventing the flow of more product from container 11 into the cylinder 22. Release of head 15 allows spring 21 to urge the piston 16 back up inside the accumulator cylinder 22 to its original rest position while also allowing for the unseating of check ball valve 23 allowing more product to flow into accumulator cylinder 22 from the container 11. As this is occurring, the follower piston 13 moves upwardly to avoid the formation of air voids within the container 11.

In designing the above system, it is preferable to insure that the lower end of the dispenser pump shown in FIG. 3 is substantially on the same level as the upper cap portion of the container 11 so that, when the follower piston 13 arrives at its uppermost position in the container 11, as little product as possible remains undispensed from the container. For this reason, a dip tube (or inductor) is not present at the lower product inlet end of the pump dispenser shown in FIG. 3, although such a component is commonly present in bulk liquid pump dispensers of this type utilized with conventional, fixed bottom product containers.

The apparatus of the present invention has certain advantages over conventional dispensers which combine the bulk liquid pump dispenser used herein with a standard bottle not containing a take-up piston. Such conventional pump/bottle dispensers cease to function if heavy viscosity products such as cold cream, petroleum jelly, and the like are contained in the bottle due to cavitation around the dip tube. The present invention solves that problem by the provision of the take-up piston in the dispenser. In regard to the type of dispensers shown in U.S. Pat. Nos. 4,511,068 and 4,598,843, the present dispensing system has differing advantages. For example, the present dispenser can be used in an upright, table top position whereas the type of dispensers shown in the two aforementioned patents need to be held and tilted in the hand in order to dispense the product due to the angle of the outlet opening in such dispensers. The present dispenser is a more closed system due to the design of the bulk liquid pump (i.e., the fact that the spring positively is biased against the sealed dispenser piston when the pump is not being used) so that product bearding at elevated temperatures is substantially reduced as compared to the type of dispenser shown in the two aforementioned patents.

The foregoing is presented for illustrative purposes only and should not, therefore, be construed in a limiting sense. The scope of protection that is sought is set forth in the claims which follow.

I claim:

1. A viscous product dispenser for cold cream or petrolatum which comprises:

(a) a generally tubular container body to hold the product;

(b) a take-up piston at the lower end of the body which responds to discharging of product from the container body by shifting its position toward the upper end of the body so as to decrease the internal volume of the container body holding the product by an amount corresponding to the volume of product discharged, and (c) a bulk liquid pump dispenser at the upper portion of the container body which comprises a product inlet extending into the container body portion intended to hold the product, and a finger depressible, spring-biased piston/cylinder pumping mechanism located above the product inlet having a product outlet conduit initially thereabove which is parallel to the axis of the product inlet.

2. A dispenser as claimed in claim 1 wherein the piston is moveable within an accumulator cylinder which has a diameter substantially less than the diameter of the container body (a).

3. A dispenser as claimed in claim 1 wherein the pump dispenser has a check valve in its product inlet.

4. A dispenser as claimed in claim 2 wherein the pump dispenser has a check valve in its product inlet.

5. A viscous product dispenser for cold cream or petrolatum which comprises:

(a) a generally tubular container body to hold the product;

(b) a take-up piston at the lower end of the body which responds to discharging of product from the container body by shifting its position toward the upper end of the body so as to decrease the internal volume of the container body holding the product by an amount corresponding to the volume of product discharged; and (c) a bulk liquid pump dispenser at the upper portion of the container body which comprises a finger depressible, spring-biased piston, encased in a cylinder spaced from the tubular container body, the cylinder having a product outlet conduit therein, the piston being movable towards and away from a reservoir within the cylinder, the reservoir being located above a product inlet extending into the container body portion intended to hold the product, the product outlet conduit in the cylinder being above the reservoir and substantially parallel to the axis of the product inlet.

6. A dispenser as claimed in claim 5 wherein the pump dispenser has a check valve in its product inlet.

* * * * *